US010006748B2

(12) United States Patent
Lutzenberger et al.

(10) Patent No.: US 10,006,748 B2
(45) Date of Patent: Jun. 26, 2018

(54) RUDDER SYSTEM

(71) Applicant: MBDA Deutschland GmbH, Schrobenhausen (DE)

(72) Inventors: Joerg Lutzenberger, Augsburg (DE); Bernd Kaebitz, Munich (DE); Robert Kroyer, Munich (DE)

(73) Assignee: MBDA Deutschland GmbH, Schrobenhausen (DE)

( * ) Notice: Subject to any disclaimer, the term of this patent is extended or adjusted under 35 U.S.C. 154(b) by 144 days.

(21) Appl. No.: 14/967,172

(22) Filed: Dec. 11, 2015

(65) Prior Publication Data

US 2016/0169642 A1 Jun. 16, 2016

(30) Foreign Application Priority Data

Dec. 11, 2014 (DE) ..... 10 2014 018 259
Apr. 9, 2015 (DE) ..... 10 2015 004 702

(51) Int. Cl.
*F42B 10/14* (2006.01)

(52) U.S. Cl.
CPC ..... *F42B 10/14* (2013.01)

(58) Field of Classification Search
CPC ..... F42B 10/64; F42B 10/14; F42B 10/16; F42B 10/143; F42B 10/20; B64C 2201/102; B64C 3/56
See application file for complete search history.

(56) References Cited

U.S. PATENT DOCUMENTS 3,058,422 A 10/1962 Olsson
3,690,595 A * 9/1972 Rusbach ..... F42B 10/14 102/348
3,819,132 A * 6/1974 Rusbach ..... F42B 10/18 244/3.28
3,918,664 A * 11/1975 Grosswendt ..... F42B 10/14 244/3.28

(Continued)

FOREIGN PATENT DOCUMENTS

CH 378734 A 6/1964
EP 0 653 604 A1 5/1995

(Continued)

OTHER PUBLICATIONS

European Search Report issued in European counterpart application No. EP 15 00 3425 dated Apr. 8, 2016, with Statement of Relevancy (Two (2) pp.).

*Primary Examiner* — Benjamin P Lee
(74) *Attorney, Agent, or Firm* — Crowell & Moring LLP

(57) ABSTRACT

A rudder system includes a pivotable rudder part, a rudder housing, on which the pivotable rudder part is rotatably mounted, and a resilient locking device. The pivotable rudder part is movable relative to the rudder housing from a pivoted-in position into a pivoted-out position. The resilient locking device is held in a pretensioned position by the pivotable rudder part when the pivotable rudder part is in the pivoted-in position such that, if the pivotable rudder part is in the pivoted-out position, the resilient locking device can be moved by tension relief from the pretensioned position into an at least partially tension-relieved position. In addition, the resilient locking device in the at least partially tension-relieved position blocks a movement of the pivotable rudder part relative to the rudder housing.

16 Claims, 6 Drawing Sheets

(56) References Cited

U.S. PATENT DOCUMENTS 4,384,691 A * 5/1983 Madderra ..... F42B 10/14 244/3.27
4,667,899 A * 5/1987 Wedertz ..... F42B 10/14 244/218
5,211,357 A * 5/1993 Leidenberger ..... F42B 10/14 244/3.28
5,383,253 A * 1/1995 Lin ..... E05F 3/20 16/299
5,820,072 A * 10/1998 Na ..... F42B 10/14 244/3.27
6,073,880 A * 6/2000 Voigt ..... F42B 10/64 244/3.24
6,092,264 A * 7/2000 Banks ..... F42B 10/14 16/289
6,559,370 B1 * 5/2003 Barker ..... F42B 19/12 114/20.1
6,695,252 B1 * 2/2004 Dryer ..... F42B 10/14 244/3.28
6,739,548 B1 * 5/2004 Bittle ..... F42B 10/16 244/3.29
7,097,132 B2 * 8/2006 Banks ..... F42B 10/64 244/3.27
8,415,598 B1 * 4/2013 Terhune ..... F42B 10/20 102/490
8,894,004 B1 * 11/2014 Scott ..... F42B 10/14 244/3.27
2002/0148927 A1 * 10/2002 Dommer ..... F42B 10/64 244/3.24
2003/0178527 A1 * 9/2003 Eisentraut ..... F42B 10/14 244/3.28
2006/0151667 A1 * 7/2006 Dennis ..... B64C 39/024 244/63
2012/0025010 A1 2/2012 Firor
2012/0228430 A1 * 9/2012 Martin ..... F42B 10/14 244/131
2016/0169643 A1 * 6/2016 Lutzenberger ..... F42B 10/14 244/3.29
2017/0131074 A1 * 5/2017 Lutzenberger ..... F42B 10/14

FOREIGN PATENT DOCUMENTS

EP 1 249 680 A1 10/2002
FR 2846079 A1 * 4/2004 ..... F42B 10/14

* cited by examiner

RUDDER SYSTEM

CROSS REFERENCE TO RELATED APPLICATIONS

This application claims priority under 35 U.S.C. § 119 from European Patent Application No. 10 2014 018 259.2, filed Dec. 11, 2014, and 10 2015 004 702.7, filed Apr. 9, 2015, the entire disclosures of which are herein expressly incorporated by reference.

BACKGROUND AND SUMMARY OF THE INVENTION

The invention relates to the rudder system described below, in particular a self-locking pivotable rudder, which is produced with the objectives of robustness, reliability and minimization of the production costs. This is achieved by the use of the fewest possible components, a functional design of production parts optimized for manufacture and the use of standard components.

Pivotable rudder systems are known from the prior art, for example, from U.S. Pat. No. 6,092,264 A. These are usually used in guided missiles which are launched from a launching tube. As soon as the guided missile has left the launching tube the pivotable rudder is pivoted out in order to be able to control the missile. In the pivoted-in state the missile has a virtually cylindrical shape so that it can be stored in the launching tube. However, the kinematics of known pivotable rudder systems is very complex and thus expensive. Moreover, known pivotable rudder systems have to be developed individually for each missile, since they are not adaptable or scalable.

Therefore, an object of the invention is to provide a rudder system which with simple and cost-effective production and assembly can be adapted simply and cost-effectively to different missile systems.

This may be achieved by a rudder system which has a pivotable rudder part, a rudder housing and a resilient locking device. The pivotable rudder part is mounted rotatably on the rudder housing, the pivotable rudder part being movable from a pivoted-in position to a pivoted-out position. In this case, the movement between the pivoted-in position and the pivoted-out position takes place relative to the rudder housing. The resilient locking device is held in a pretensioned position by the pivotable rudder part when the pivotable rudder part is in the pivoted-in position. On the other hand, if the pivotable rudder part is in the pivoted-out position the resilient locking device can be moved by tension relief from the pretensioned position into an at least partially tension-relieved position. According to the invention it is provided that the resilient locking device in the at least partially tension-relieved position blocks a movement of the pivotable rudder part relative to the rudder housing. In particular, it is provided that the pivotable rudder part in the pivoted-out position is completely surrounded by the rudder housing and the resilient locking device. Thus, in particular, pivoting in of the pivotable rudder part is prevented, so that it is ensured that the pivotable rudder part remains pivoted out. If the rudder system is used on a guided missile, it is ensured that the rudder system always remains in the pivoted-out state. Thus a secure and reliable control of the missile is ensured.

A first resilient element is preferably provided which is mounted on a pivot pin. The pivot pin is connected to the control surface housing and in particular also supports the pivotable rudder part. Thus in particular it is provided that a movement of the pivotable rudder part relative to the rudder housing takes place by rotation of the pivotable rudder part about the pivot pin. Furthermore, it is preferably provided that a spring force of the first resilient element forces the pivotable rudder part into the pivoted-out position. Thus the rudder system can be pivoted out autonomously so that a force acting from the exterior is necessary in order to hold the pivotable rudder part in the pivoted-in position. The first resilient element is particularly advantageously a first leg spring.

It is preferably provided that the resilient locking device comprises a second resilient element, in particular a second leg spring. The second resilient element, in particular the second resilient leg spring, is advantageously oriented perpendicular to the first resilient element, in particular to the first leg spring. In this case, it is provided that each leg spring has a characteristic plane which extends parallel to the legs of the leg spring. Furthermore, each leg spring has an axis of rotation which is perpendicular to the characteristic plane and about which the legs of the leg spring are rotatable. If two leg springs are oriented perpendicular to one another, it is in particular provided that both the characteristic planes and also the axis of rotation are oriented perpendicular to one another.

Particularly advantageously, the resilient locking device comprises a movable first leg and a second leg at least partially fastened to the rudder housing. The first leg is in particular rotatable about the axis of rotation of the leg spring of the resilient locking device. The second leg is in particular held between two cylindrical pins by non-positive engagement. In this case, it is provided that the second leg bears against a wall of the rudder housing, so that the resilient locking device can be supported by the second leg on the rudder housing.

The pivotable rudder part advantageously has a rudder foot supported on the rudder housing and a rudder blade fastened to the rudder foot. In this case, it is provided that in the pivoted-out position of the pivotable rudder part the rudder foot bears against the rudder housing and the movable leg, so that a movement of the rudder foot relative to the rudder housing is blocked. In particular it is provided that the rudder housing itself blocks a movement of the rudder foot which is produced by the resilient spring force of the first resilient element, whereas the movable leg blocks a movement of the rudder foot which is oriented against the spring force of the first resilient element.

The resilient device is advantageously mounted on the rudder housing by means of a retaining element. In this case, it is provided that the retaining element is oriented parallel to the axis of rotation of the leg spring of the resilient locking device. The first leg of the resilient locking device is rotatable about the retaining element for movement between the pretensioned position and the at least partially tension-relieved position.

Furthermore, it is preferably provided that the rudder housing has a recess. The recess is in particular an opening. The first leg engages in the recess when this leg is in the at least partially tension-relieved position. In this way, an additional retention of the first leg is provided, so that the first leg can effectively block a movement of the rudder foot of the pivotable rudder part relative to the rudder housing. In particular, it is provided that one end of the first leg which is directed away from the retaining element engages in the recess, so that one end of the first leg is fastened by the retaining element to the rudder housing, and the other end is fastened by the recess.

Moreover, it is preferably provided that the recess has a taper region and an end region. In this case, the end region has flanks which extend parallel. In this case, it is provided that the taper region serves so that the first leg can engage in a simplified manner in the recess. Thus, in particular, a situation is avoided whereby the first leg engages beyond the recess and thus could not be moved into the at least partially tension-relieved position. The end region serves for guiding the first leg into the at least partially tension-relieved position.

Thus, particularly advantageously, the first leg engages in the recess when this first leg is in the at least partially tension-relieved position. In particular, it is provided that an internal dimension of the end region, which is defined in particular by a spacing of the parallel flanks of the end region, corresponds to an external dimension of the first leg. According to the invention it is provided that the internal dimension and the external dimension correspond to one another when they have a maximum deviation of 5%. Thus the first leg is partially received by positive engagement in the recess. In particular, this partial positive engagement only allows a movement of the first leg in the direction of the taper region. Thus it is ensured that the blocking action of the first leg is only based on the fact that the first leg is subjected to shearing load. Thus, by the limitation to pure shearing loads, the first leg is very stable, so that secure blocking of the movement of the rudder foot of the pivotable rudder part is made possible.

Finally, it is preferably provided that the rudder foot has a chamfer. The chamfer is applied to the rudder foot in such a way that the first leg is pressed against the chamfer by the relief of tension in the resilient latching device when the pivotable rudder part is located between the pivoted-in position and the pivoted-out position. In this way, an additional force is applied to the rudder foot and thus to the pivotable rudder part, wherein the additional force reinforces a pivoting out of the pivotable rudder part into the pivoted-out position. Thus fast pivoting out of the pivotable rudder part is ensured.

Moreover, the rudder system advantageously has a pivot pin receptacle by means of which the entire rudder system can be mounted on an actuator pivot pin. Thus the rudder system does not penetrate the shell of the missile, so that the rudder system can be used on a plurality of missiles or can be adapted flexibly to the missiles. In order to simplify the pivoting out of the pivotable rudder part by the first resilient element, the rudder foot also advantageously has a groove. The first resilient element is advantageously a second leg spring, so that a leg of the second leg spring engages in the groove of the rudder foot, whereas the other leg bears against the rudder housing. Thus since the second leg spring is in particular mounted on the same pivot pin on which the pivotable rudder part is also mounted, a simple and reliable transmission of force between the second leg spring and the pivotable rudder part is made possible.

The pivotable rudder is characterized by not only the robustness and reliability but also by the possibility of scaling and simple adaptation to other missiles, since the rudder is only applied externally to the rudder pivot pin on the rudder of the actuator system and does not encroach into the shell of the missile.

Other objects, advantages and novel features of the present invention will become apparent from the following detailed description of one or more preferred embodiments when considered in conjunction with the accompanying drawings.

BRIEF DESCRIPTION OF THE DRAWINGS

FIG. 2 shows a schematic view of the rudder system according to the exemplary embodiment of the invention with the pivotable rudder part pivoted in.

DETAILED DESCRIPTION OF THE DRAWINGS

Figure 1:
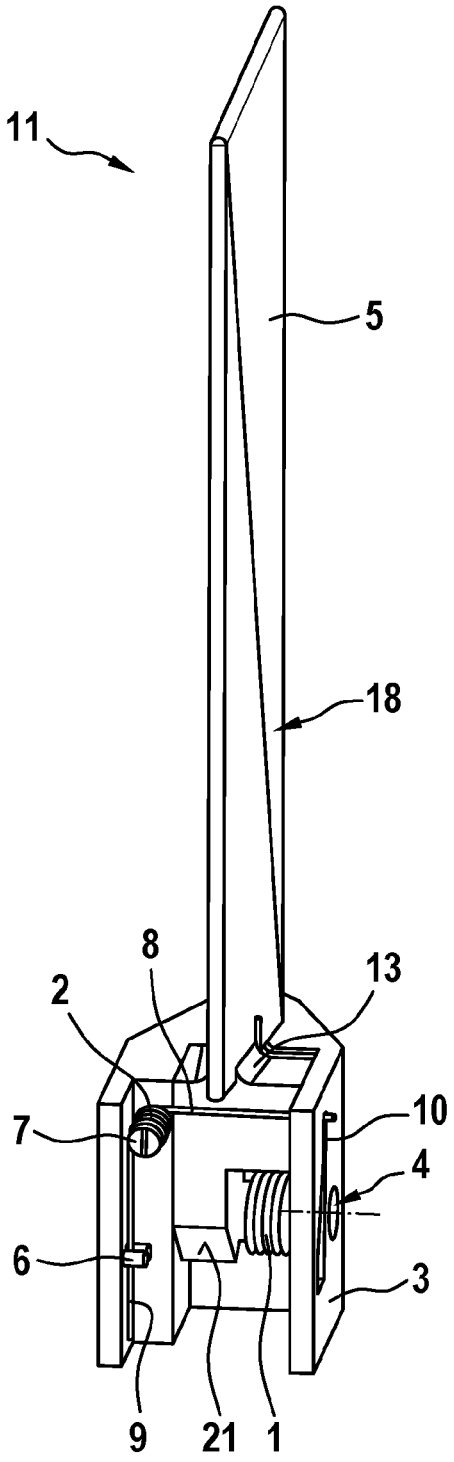
FIG. 1 shows a schematic view of a rudder system according to an exemplary embodiment of the invention with the pivotable rudder part pivoted out.
Figure 2:
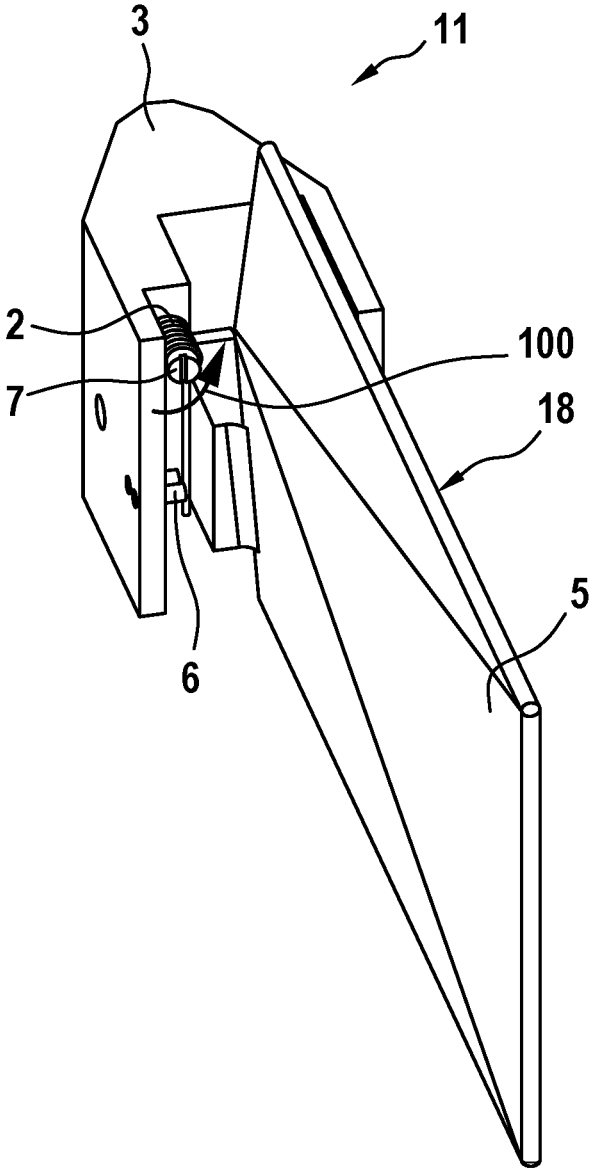
Figure 3:
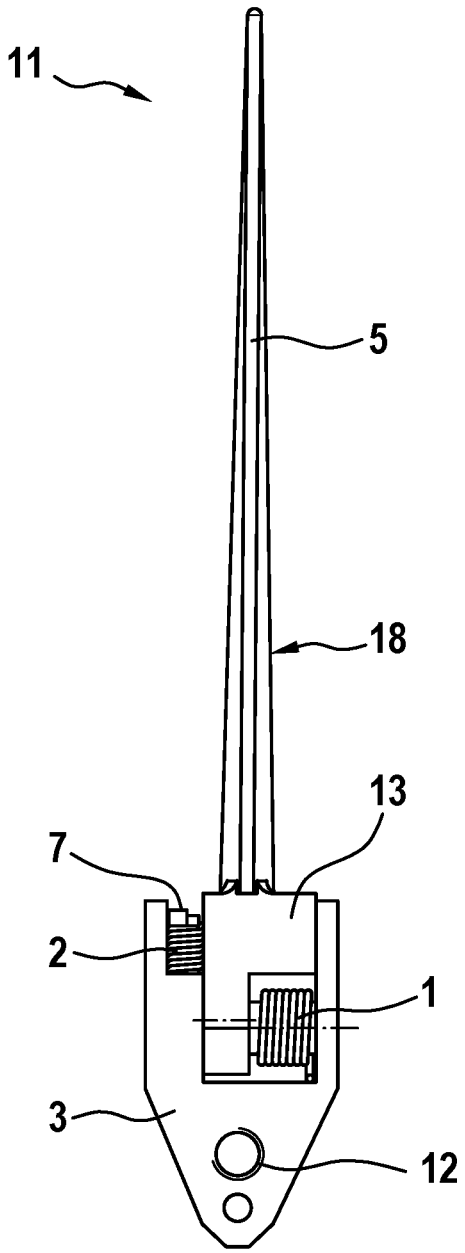
FIG. 3 shows a schematic view of the rudder system according to the exemplary embodiment of the invention with the pivotable rudder part pivoted out.

FIGS. 1 to 3 show different views of the rudder system 11 according to an exemplary embodiment of the invention. In this case, the rudder system 11 is pivoted out in FIGS. 1 and 3 and pivoted in FIG. 2. For pivoting in and out the rudder system 11 has a pivotable rudder part 18 which is mounted rotatably by means of a pivot pin 4 on a rudder housing 3. In order to move the pivotable rudder part 18 between the pivoted-out position shown in FIGS. 1 and 3 and the pivoted-in position shown in FIG. 2, the pivotable rudder part must be rotated about the pivot pin 4 relative to the rudder housing 3.

The pivotable rudder part 18 has a rudder blade 5 and a rudder foot 13. The rudder foot is mounted by means of the pivot pin 4 on the rudder housing 3, whereas the rudder blade 5 serves as an aerodynamic rudder. In order that the movable rudder part 18 can be moved autonomously from the pivoted-in position into the pivoted-out position, the rudder system 11 has a first resilient element 1. The first resilient element 1 is in particular a first leg spring 1.

A first leg of the first leg spring 1 is inserted in a pretensioned manner in the groove 14 of the rudder foot 13, and a second leg is supported on the rudder housing 3. The spring body of the first leg spring 1 is accommodated in a recess in the rudder foot 13 and is centered by the pivot pin 4 which, moreover, constitutes the articulated connection between the pivotable rudder part 18 and the rudder housing 3. After the insertion of the first leg spring 1, the pivot pin is pressed into the rudder housing 3.

Thus the pivotable rudder part 18 is can move autonomously into the pivoted-out position. Thus the pivotable rudder part 18 must be secured by an external force in order to hold the pivotable rudder part in the pivoted-in position.

If the pivotable rudder part 18 is freed, the torque of the first leg spring 1 causes the straightening up of the pivotable rudder part in the end position until the rudder foot 13 strikes the rudder housing 3. The end position of the pivotable rudder part 18 is reached when the pivotable rudder part is in the pivoted-out position. For locking a resilient locking device is used, in particular a second leg spring 2 of which one leg itself acts as a latch.

The second leg spring 2 comprises a first leg 8 and a second leg 9. In this case the first leg 8 is movable and serves in particular as a latch in order to achieve said locking. The second leg 9 is preferably fastened to a wall of the rudder housing 3. Furthermore, the second leg spring 2 has a spring body.

The spring body of the second leg spring 2 is mounted on the rudder housing 3 by a retaining element 7, in particular by a press-fitted pin with flange (cf. FIG. 5), or a screw. In this case no force should be applied to the spring body of the second leg spring 2, since the second leg spring 2 must remain freely movable. The second leg 9 of the second leg spring 2 is supported on the housing wall of the rudder housing 3 and is held between two cylindrical pins 6 which are pressed into the rudder housing 3 so that the location thereof is fixed under initial tension. The first leg 8 of the second leg spring 2 is supported in the pivoted-in state of the pivotable rudder part 18 on the rudder foot 13. If the pivotable rudder part 18 is straightened up, the rudder foot 13 slides on the first leg 8 until sufficient space is available for it to relieve the initial tension by rotation. In this way the tension of the resilient locking device is relieved, so that a rotation 100 of the first leg 8 is generated.

The output torque in this case additionally supports the pivoting out of the pivotable rudder part 18 when the first leg 8 engages under the rudder foot 13, in particular on a chamfer 21 of the rudder foot 13. In the wall of the rudder housing 3 opposite the cylindrical pins 6 there is a recess or opening 10 which tapers upwards in a taper region 19 and finally transitions into a vertical region without flank slope, i.e. the end region 20. This serves to "catch" the first leg 8 of the second leg spring 2 and to guide it into the at least partially tension-relieved position. In the vertical slope-free region of the recess flanks, i.e. in the end region 20, a geometric blocking of the first leg 8 takes place, i.e. a force applied by the pivotable rudder part 18 to the first leg 8 acting as a transverse lock subjects the first leg 8 to shearing load on the two outer edges of the foot of the first leg 8. A deflection of the leg 8 acting as a latch is precluded.

A second leg spring 2 is configured in such a way that in the end position defined by the recess 10, i.e. in the partially tension-relieved position, it retains some residual initial tension in order always to ensure the maintenance of the position.

Finally, it can be seen from FIG. 3 that the rudder housing 3 has a pivot pin receptacle 12. The pivot pin receptacle 12 serves for linking the rudder system 11 to an actuator, so that the rudder system 11 can be moved by the actuator. In this case, it can be seen that the rudder system 11 can be fastened in a very simple manner to the actuator. In particular, the rudder system 11 must not penetrate the outer shell of a missile.

Figure 4:
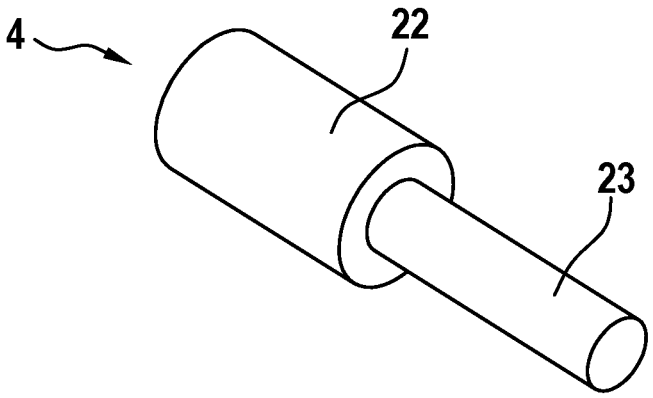
FIG. 4 shows a schematic view of the pivot pin of the rudder system according to the exemplary embodiment of the invention.

FIG. 4 shows the pivot pin 4 of the rudder system 11. The pivot pin 4 has a first region 22 and a second region 23. In this case, it is provided that the first region 22 serves for mounting of the first leg spring 1, i.e. for mounting of the first resilient element 1, whereas the second region 23 serves for mounting of the rudder foot 13 of the pivotable rudder part 18.

Figure 5:
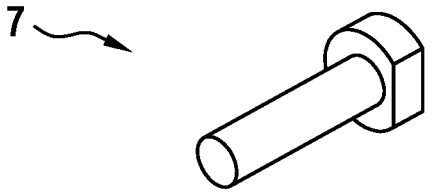
FIG. 5 shows a schematic view of the retaining element of the rudder system according to an exemplary embodiment of the invention.

FIG. 5 shows schematically the retaining device 7 for linking the second leg spring 2, i.e. the selected one, to the actuator system. The pivot pin receptacle 12 serves for linking the rudder housing 3 and thus the entire rudder system 11 to an actuator. By means of the actuator, the rudder housing 3, and thus the rudder system 11, can be moved, so that an incident flow on the rudder blade 5 can be changed. This leads to a change of movement of the missile. resilient locking device 2, to the rudder housing 3. In the form shown in FIG. 5 the retaining element 7 is a retaining pin, wherein the retaining element may also be a screw.

Figure 6:
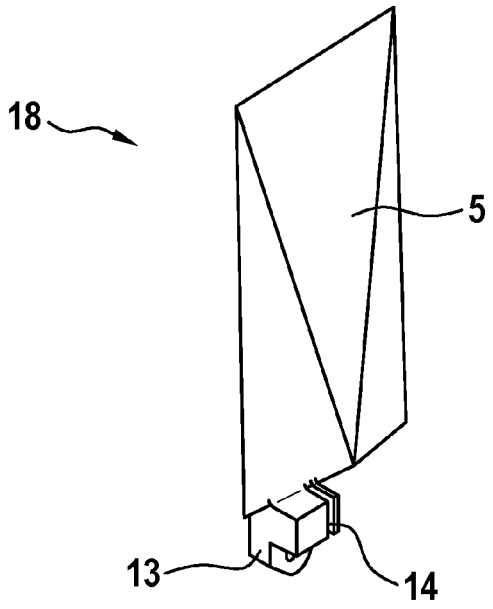
FIG. 6 shows a schematic view of the pivotable rudder part of the rudder system according to the exemplary embodiment of the invention.

FIG. 6 shows the pivotable rudder part 18 schematically. The pivotable rudder part 18 has a rudder blade 5 in addition to the rudder foot 5, the rudder blade 5 serving as an aerodynamic rudder. In the rudder foot 13 there is a groove 14, which serves to receive a leg of the first leg spring 1, i.e. to receive the first resilient element 1.

Figure 7:
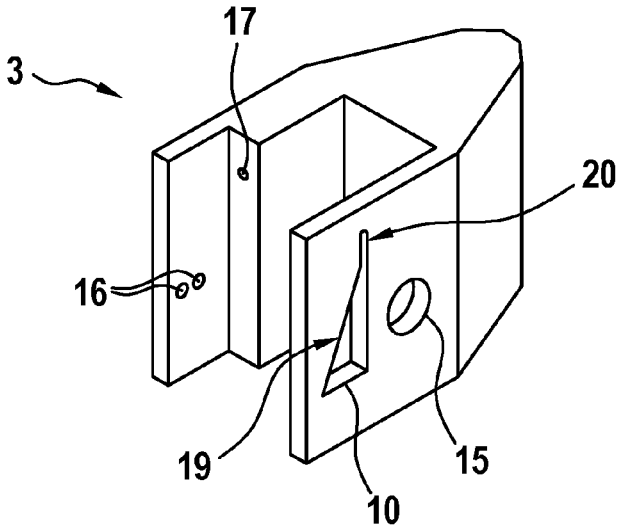
FIG. 7 shows a schematic view of the rudder housing of the rudder system according to the exemplary embodiment of the invention.
Figure 8:
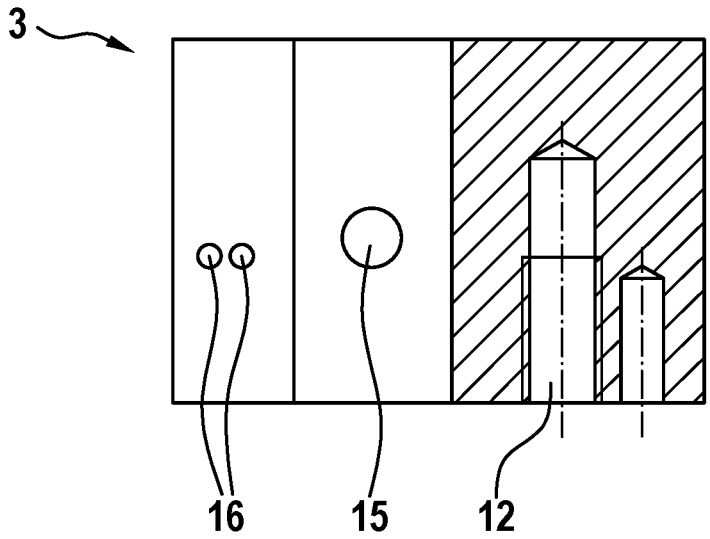
FIG. 8 shows a schematic view of the rudder housing of the rudder system according to the exemplary embodiment of the invention.

FIG. 7 shows a schematic view of the rudder housing 3. FIG. 8 shows a sectional view through the rudder housing 3. As can be seen from these drawings, the rudder housing 3 has a recess or opening 10 which has a taper region 19 and an end region 20. The function of the taper region 19 and of the end region 20 has previously been described in detail. Moreover the rudder housing 3 has a retaining element receptacle 17. The retaining element receptacle 17 may be a thread if the retaining element 7 is a screw or may be a hole if the retaining element 7 is a retaining pin.

To receive the cylindrical pin 6 the rudder housing 3 also has two pin receptacles 16 which are in particular holes. In this case the cylindrical pins 6 can be pressed into the pin receptacle 16. Likewise, the rudder housing 3 has a pivot pin bearing receptacle 15 on which the pivot pin 4 can be coupled to the rudder housing 3. In particular, it is provided that the pivot pin 4 can be pressed into the pivot pin bearing receptacle 15 of the rudder housing 3, so that the pivot pin 4 is connected non-rotatably to the rudder housing 3.

Finally, the rudder housing 3 has a pivot pin receptacle 12. In this exemplary embodiment the pivot pin receptacle 12 is in particular a threaded bore, so that an actuator pivot pin can be screwed into the pivot pin receptacle 12. The embodiment of the pivot pin receptacle may also be designed as a simple hole if an adhesive joint for connection of the rudder.

In addition to the foregoing written disclosure, for further disclosure of the invention, reference is also made explicitly to the representation in FIGS. 1 to 8.

LIST OF REFERENCE SIGNS

1 first resilient element (first leg spring)
2 resilient locking device (second leg spring)
3 rudder housing
4 pivot pin
5 rudder blade
6 cylindrical pins
7 retaining element (retaining pin, screw)
8 first leg
9 second leg
10 recess (opening)
11 rudder
12 pivot pin receptacle
13 rudder foot
14 groove
15 pivot pin bearing receptacle
16 pin receptacle
17 retaining element receptacle
18 pivotable rudder part
19 taper region
20 end region
21 chamfer
22 first region of the pivot pin
23 second region of the pivot pin
100 rotation The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A rudder system comprising:

a pivotable rudder part;

a rudder housing, on which the pivotable rudder part is rotatably mounted;

a first resilient element designed as a first leg spring, which is mounted on a pivot pin fastened to the rudder housing, wherein a spring force of the first resilient element forces the pivotable rudder part into the pivoted-out position; and a resilient locking device, wherein the pivotable rudder part is movable relative to the rudder housing from a pivoted-in position into a pivoted-out position, wherein the resilient locking device is held in a pretensioned position by the pivotable rudder part when the pivotable rudder part is in the pivoted-in position, wherein if the pivotable rudder part is in the pivoted-out position the resilient locking device can be moved by tension relief from the pretensioned position into an at least partially tension-relieved position, wherein the resilient locking device in the at least partially tension-relieved position blocks a movement of the pivotable rudder part relative to the rudder housing, wherein the resilient locking device comprises a second resilient element designed as a second leg spring, wherein the resilient locking device has a movable first leg and a second leg at least partially fastened to the rudder housing that blocks movement of the rudder once in the pivoted-out position, and wherein the pivotable rudder part has a rudder foot mounted on the rudder housing and a rudder blade fastened to the rudder foot, wherein a first leg of the first leg spring is inserted in a pretensioned manner in a groove of the rudder foot, and a second leg of the first leg spring is supported on the rudder housing.

2. The rudder system according to claim 1, wherein the pivotable rudder part is mounted on the pivot pin.

3. The rudder system according to claim 1, wherein the first resilient element comprises a first leg spring.

4. The rudder system according to claim 1, wherein the rudder foot in the pivoted-out position of the pivotable rudder part bears against the rudder housing and the first leg, so that a movement of the rudder foot relative to the rudder housing is blocked.

5. The rudder system according to claim 1, wherein the resilient locking device is mounted by means of a retaining element on the rudder housing, wherein the first leg is rotatable about the retaining element for movement between the pretensioned position and the at least partially tension-relieved position.

6. The rudder system according to claim 4, wherein the resilient locking device is mounted by means of a retaining element on the rudder housing, wherein the first leg is rotatable about the retaining element for movement between the pretensioned position and the at least partially tension-relieved position.

7. The rudder system according to claim 1, wherein the rudder housing has a recess in which the first leg engages in the at least partially tension-relieved position.

8. The rudder system according to claim 4, wherein the rudder housing has a recess in which the first leg engages in the at least partially tension-relieved position.

9. The rudder system according to claim 5, wherein the rudder housing has a recess in which the first leg engages in the at least partially tension-relieved position.

10. The rudder system according to claim 7, wherein the recess has a taper region and an end region, wherein the end region comprises parallel flanks.

11. The rudder system according to claim 8, wherein the recess has a taper region and an end region, wherein the end region comprises parallel flanks.

12. The rudder system according to claim 9, wherein the recess has a taper region and an end region, wherein the end region comprises parallel flanks.

13. The rudder system according to claim 10, wherein, in the at least partially tension-relieved position, the first leg engages in the end region, wherein an internal dimension of the end region corresponds to an external dimension of the first leg.

14. The rudder system according to claim 11, wherein, in the at least partially tension-relieved position, the first leg engages in the end region, wherein an internal dimension of the end region corresponds to an external dimension of the first leg.

15. The rudder system according to claim 12, wherein, in the at least partially tension-relieved position, the first leg engages in the end region, wherein an internal dimension of the end region corresponds to an external dimension of the first leg.

16. The rudder system according to claim 1, wherein rudder foot has a chamfer, wherein the first leg is pressed against the chamfer by the relief of tension in the resilient locking device when the pivotable rudder part is located between the pivoted-in position and the pivoted-out position.

* * * * *